US009196167B2

(12) United States Patent
Campagne et al.

(10) Patent No.: US 9,196,167 B2
(45) Date of Patent: Nov. 24, 2015

(54) PROCESS AND DEVICE FOR MANAGING THE ACTIVATING OF A WARNING MESSAGE IN AN AIRCRAFT

(75) Inventors: Pierre Campagne, Toulouse (FR); Boris Sorbier, Merville (FR); Baptiste Maylin, Toulouse (FR)

(73) Assignees: AIRBUS, Blagnac (FR); AIRBUS OPERATIONS SAS, Toulouse (FR)

( * ) Notice: Subject to any disclaimer, the term of this patent is extended or adjusted under 35 U.S.C. 154(b) by 1259 days.

(21) Appl. No.: 12/145,793

(22) Filed: Jun. 25, 2008

(65) Prior Publication Data

US 2009/0015437 A1 Jan. 15, 2009

(30) Foreign Application Priority Data

Jun. 29, 2007 (FR) ..... 07 56180

(51) Int. Cl.
*G08B 21/00* (2006.01)
*G08C 23/00* (2006.01)
*G08G 5/00* (2006.01)

(52) U.S. Cl.
CPC ..... *G08G 5/0091* (2013.01); *G08G 5/0021* (2013.01); *G08G 5/0078* (2013.01); *G08G 5/0086* (2013.01)

(58) Field of Classification Search
CPC ..... G08B 21/00; G01C 23/00; G08G 5/0021; G08G 5/0078; G08G 5/0091
USPC ..... 340/945, 963, 947, 949, 951–953, 340/959–962, 965–970; 455/512, 701; 704/267, 274; 701/4, 9, 10, 14
See application file for complete search history.

(56) References Cited

U.S. PATENT DOCUMENTS

| | | | | |
|---|---|---|---|---|
| 2,804,501 | A * | 8/1957 | Hart | 379/51 |
| 3,641,496 | A * | 2/1972 | Slavin | 704/274 |
| 6,002,347 | A * | 12/1999 | Daly et al. | 340/963 |
| 6,043,757 | A * | 3/2000 | Patrick | 340/963 |
| 6,700,482 | B2 * | 3/2004 | Ververs et al. | 340/500 |
| 7,088,264 | B2 * | 8/2006 | Riley | 340/963 |
| 2007/0255498 | A1 * | 11/2007 | McDaniel et al. | 701/301 |
| 2008/0153529 | A1 * | 6/2008 | O'Neill et al. | 455/512 |

FOREIGN PATENT DOCUMENTS

| | | |
|---|---|---|
| EP | 0 895 602 | 2/1999 |
| EP | 0 964 381 A2 | 12/1999 |
| FR | 2 343 223 | 9/1997 |
| WO | WO 97/40401 | 10/1997 |

* cited by examiner

*Primary Examiner* — Hung T Nguyen
(74) *Attorney, Agent, or Firm* — Oblon, McClelland, Maier & Neustadt, L.L.P.

(57) ABSTRACT

A process for managing the activating of emission of a given warning message in an aircraft comprises transmission, from a monitoring system to an authorization-issuing system, of an emission authorization request. The request has a priority attribute known as request priority attribute. The process also includes transmission, from the authorization-issuing system to the monitoring system, of an emission authorization. The transmission of the emission authorization is effected if the request priority attribute is higher than a current priority threshold. In addition, the process includes activation of emission of the given warning message. The activation may be effected if an alert condition associated with the given warning message is detected and if a priority attribute associated with the alert condition is higher than or equal to the request priority attribute.

19 Claims, 4 Drawing Sheets

PROCESS AND DEVICE FOR MANAGING THE ACTIVATING OF A WARNING MESSAGE IN AN AIRCRAFT

BACKGROUND OF THE INVENTION

1. Field of the Invention

The present invention relates to a process and an associated device for managing the activating of a warning message in an aircraft.

2. Discussion of the Background

In an aircraft cockpit, different monitoring systems are in charge of emitting alert messages in case of detection of an abnormal situation.

Firstly, the system for monitoring flight conditions ("Flight Warning System" (FWS), "Flight Warning Computer" for flight alert computer or also "Flight Warning Application" for flight alert application) is an on-board system intended to forewarn the crew members of an abnormal situation concerning the airplane or a monitored system of the airplane.

The monitored systems may include detectors or calculators relating, for example, to the engines, to the fuel tanks or to the landing gears.

The system for monitoring flight conditions also emits automatic altitude announcements when the airplane passes through certain altitudes.

Furthermore, other monitoring systems have the function of forewarning the crew of risks related to the environment of the aircraft.

This is the case of the systems known as TAWS ("Terrain Awareness and Warning System" or warning and impact alert system), GPWS ("Ground Proximity Warning System" or ground proximity warning device), TCAS ("Traffic Collision Avoidance System" or on-board anti-collision system, also known as ACAS), WxR ("Weather Radio" or weather radar) and PWS ("Predictive Windshear System", a shear prediction system).

It is possible to integrate several of the equipment items that monitor the environment of the aircraft in a single monitoring system, known, for example, as AESS ("Aircraft Environment Surveillance System" or aircraft environment monitoring system).

These different alert systems, whether their function is to monitor a system of the aircraft or of its environment, communicate with the pilot by alert messages, which may include the display of text messages on screens, the illumination of lamps and the emission of acoustic messages, such as voice syntheses or mixes of acoustic signals and voice syntheses known as "hybrids".

The solution adopted until now to manage the activating of acoustic messages involved preliminary classification of alert conditions into two categories: high-priority alert conditions and normal-priority alert conditions.

In the event of detection of a high-priority alert condition by an alert system, emission of the corresponding warning message is activated immediately, and an information item according to which a high-priority warning message is in the course of emission is sent to all other alert systems.

In the event of detection of a normal-priority alert condition by an alert system, the emission of the corresponding warning message is activated immediately, except when a high-priority warning message is in the course of emission.

SUMMARY OF THE INVENTION

The solution proposed here seeks to improve the management of activating of emission of warning messages, such as emission of acoustic messages.

According to a first aspect, the invention proposes a process for managing an activating of emission of a given warning message in an aircraft, characterized in that it comprises the following successive steps:

- transmission, from an alert system to a centralizing authorization-issuing system in charge of issuing emission authorizations, of a request to authorize emission of a warning message, the said request possessing a priority attribute known as request priority,
- transmission, from the said authorization-issuing system to the said alert system, of an authorization to emit a warning message, the transmission of the said authorization to emit a warning message being effected if the said request priority attribute is higher than a current priority threshold,
- activation, by the alert system, of emission of the given warning message, the said activation of emission being effected if an alert condition associated with the said given warning message is detected and if a priority attribute associated with the said alert condition is higher than or equal to the said request priority attribute.

By virtue of this process, the warning message is emitted only if appropriate authorization is issued beforehand by the authorization-issuing system, which may be a centralizing system that centralizes diverse information items originating from airplane systems, which information items may concern, among other aspects, the functioning of airplane systems, or measurements made concerning the flight, such as altitude.

The information items centralized by the authorization-issuing system may pertain to processes in progress, especially emissions of acoustic messages in progress by different avionic systems.

As a function of these information items, the authorization-issuing system updates a current priority threshold.

For example, this current priority threshold may be calculated on the basis of a priority information item relating to broadcast of a warning message in progress. Such a warning message then defines the current priority threshold to the effect that only the warning messages having higher priority according to a predetermined convention can be emitted.

Furthermore, this priority information item relating to the broadcast of a warning message in progress, which determines the current priority threshold, may depend on information items relating to the flight conditions, measured or calculated in real time if applicable. The current priority threshold can therefore vary as a function of these information items relating to the flight conditions.

The process then makes it possible to prevent a message from being emitted by the alert system while a message of higher priority is in the course of emission by another avionic system.

That is advantageous because, if several warning messages are emitted simultaneously, the crew members tend to have difficulty in understanding them.

It will be noted that the warning messages in question may be acoustic messages, although they may also be texts displayed on a screen or any other display means, or even combinations of sounds and texts.

Furthermore, the process may also comprise a preliminary step of activating an alert process, comprising, for example, a step of reception, by the alert system, of an information item representative of a detected alert condition and a step of determination of a priority attribute associated with the detected alert condition.

If applicable, the priority attribute associated with the detected alert condition may evolve as a function of information items measured or calculated in real time.

According to one characteristic, the request priority attribute is taken as equal to such a priority attribute of an alert condition detected at the moment of the beginning of transmission of the request.

The activation of an emission of the given warning message is effected if an information item representative of a detected alert condition associated with the said given warning message has been received and if a priority attribute associated with the said alert condition is higher than or equal to the said request priority attribute.

If applicable, activation is effected if the information item representative of a detected alert condition is still valid, for example after transmission of the emission authorization or, for example, at the moment at which the alert system is ready to proceed to activation.

Finally, it is appropriate to note that the process explained hereinabove may be applicable to different fields. As an example, it may be applicable to the activation of alert messages in any monitored complex system whatsoever.

According to one characteristic, the step of activation of emission of the warning message comprises a sub-step of transmission, from the alert system to the authorization-issuing system, of an information item known as alert in progress. This transmission is effected to indicate that an alert is effectively in progress.

By virtue of this characteristic, the authorization-issuing system can use the information item about an alert in progress to modulate the sequence of another process. Such other process may be the emission of a warning message for which an emission authorization request has been transmitted to the authorization-issuing system after the transmission of the information item about an alert in progress.

According to one characteristic, the information item about an alert in progress possesses a priority attribute known as alert in progress, which may be the priority attribute of the warning message in the course of emission. This priority attribute of alert in progress may be used by the authorization-issuing system to update the current priority threshold.

According to one characteristic, the transmission of an information item about alert in progress is effected if the alert system effectively commands the emission of the warning message.

By virtue of this characteristic, the information item about the alert in progress adapts to the effective state of the alert system, thus offering reliable information feedback to the authorization-issuing system, which then knows whether or not the alert that it has authorized is effectively in progress, since it is possible that different events may have prevented an authorized alert from being activated rapidly.

Furthermore, according to one characteristic, the process comprises a preliminary step of activating an alert process, which step comprises a sub-step of transmission, from the said authorization-issuing system to the said alert system, of an authorization to request authorization to emit a warning message, transmission of an emission authorization request being effected if an alert condition is detected and if the alert system is authorized to emit a request for a warning message associated with the alert condition. It will be noted that the request authorization information item may define, according to a convention installed beforehand in the alert system, a request authorization or a request prohibition for one or more messages.

According to one characteristic, the step of activating an alert process comprises a sub-step of transmission, from the said authorization-issuing system to the said alert system, of an information item about activation of a warning message, transmission of an emission authorization request being effected if the warning message is activated and if an alert condition associated with the warning message is detected.

It is stipulated that the information item about activation of a warning message may define activation of one or more warning messages and deactivation of one or more warning messages, the activation of all warning messages or the deactivation of all warning messages.

By virtue of this characteristic, the emission authorization request is transmitted to the authorization-issuing system only if the warning message is active, or in other words if the authorization-issuing system has previously activated it or has not previously deactivated it.

Thus the number of requests emitted by the alert system is reduced.

According to one characteristic of use, the information item about activation of a warning message possesses a priority attribute known as "activation" priority. According to this characteristic, the warning messages with priority attribute higher than the activation priority attribute are activated, and the warning messages with priority attribute lower than the activation priority attribute are deactivated.

Preferably the activation priority attribute is determined as a function of the current priority threshold, which, as has been seen, is updated by the authorization-issuing system as a function of information items centralized by the authorization-issuing system.

Thus it is possible that the warning messages with priority attribute higher than the current priority threshold taken at the moment of dispatch of the activation information item are activated, and the warning messages with priority attribute lower than the current priority threshold in effect at the moment of dispatch of the activation information item are deactivated.

More generally, the activation priority attribute may be determined as a function of information items centralized by the centralizing system.

Furthermore, according to one characteristic, the said given warning message is supplemented at its beginning by a silence of predetermined duration, known as cutoff, if the emission authorization comprises a delay order.

According to this characteristic, the emission of information items contained in the warning message takes place only after the cutoff duration has elapsed following the transmission of an emission authorization from the authorization-issuing system to the alert system.

According to one characteristic, the emission authorization comprises a delay order if a decision to interrupt a warning message in the course of emission by an avionic system has been made, for example, in the authorization-issuing system.

This characteristic makes it possible to improve the intelligibility of warning messages during their emission, which takes place in controlled manner, and therefore their comprehension by the crew members. In fact, the warning messages are better separated from one another, and so they overlap less.

Preferably the cutoff duration ranges between 300 and 700 ms and, for example, is equal to 500 ms. As an example, the cutoff duration is counted from the end of transmission of the emission authorization.

According to one characteristic, the transmission of an information item about an alert in progress is effected if the alert system commands the emission of the warning message, including the silence for the duration of a cutoff that supplements the message at its beginning.

According to a second aspect, the invention proposes a system for managing the activating of emission of a given warning message, characterized in that it comprises:

means for transmitting a request for authorization to emit a warning message from an alert system to an authorization-issuing system, means for transmitting an authorization to emit a warning message from the authorization-issuing system to the alert system, means for modulating transmission of an authorization to emit a warning message, the said transmission of an authorization to emit a warning message being effected if a priority attribute known as request priority of a request to authorize emission of a warning message transmitted from the alert system to the authorization-issuing system is higher than a current priority threshold, and means for modulating activation of emission of the given warning message, the said activation being effected if an alert condition associated with the said given warning message is detected and if a priority attribute associated with the said alert condition is higher than or equal to the said request priority attribute.

If applicable, the management system comprises only means for modulating transmission, from an authorization-issuing system to an alert system, of an emission authorization, the said transmission of an emission authorization being effected if a priority attribute known as request priority of a request to authorize emission transmitted from the alert system to the authorization-issuing system is higher than a current priority threshold, and means for modulating activation of emission of the given warning message, the said activation being effected if an alert condition associated with the said given warning message is detected and if a priority attribute associated with the said alert condition is higher than or equal to the said request priority attribute.

By virtue of this management system, the warning message is emitted only if an authorization is issued beforehand by an authorization-issuing system.

The authorization-issuing system may be a centralizing system that is informed about emissions of acoustic messages in progress by different alert systems. It then makes it possible to prevent a low-priority message from being emitted when a high-priority message is in the course of emission.

According to one characteristic, the management system additionally comprises means for determining and/or updating a current priority threshold, which means are included, for example, in the authorization-issuing system.

The means for modulating the transmission of an emission authorization may be included in the authorization-issuing system. The means for modulating activation of emission of a warning message in turn may be included in the alert system.

Furthermore, the management system may comprise means for receiving an information item representative of an alert condition, which means are included, for example, in the alert system, and means for determining a priority attribute known as alert priority, detected for an information item representative of a detected alert condition, which means are also included in the alert system.

According to one characteristic, the means for modulating activation of emission of a warning message include means for measuring a duration known as activation duration, counted from the transmission of an emission authorization, the activation of emission of a warning message being effected during the activation duration.

According to this characteristic, the activation of emission of the warning message is achieved before a predetermined activation duration has elapsed. This is advantageously counted after the end of transmission of an emission authorization.

In fact, according to this characteristic, the activation of emission is authorized only during this activation duration, which makes it possible to undertake activation of emission only if an emission authorization has been received a short time before the moment at which activation is possible, in which case the authorization is still valid at the moment of activation.

Preferably the activation duration ranges between 150 and 250 ms and, for example, is equal to 200 ms.

According to one characteristic, the means for modulating transmission of an emission authorization comprise means for measuring a duration known as prohibition duration, which can be counted from a given moment, the transmission of an emission authorization being effected after the end of the prohibition duration.

The given moment may be the moment of a decision about emission authorization made by the authorization-issuing system before it had received the emission authorization request. This given moment may be, for example, the moment of the beginning of a preceding transmission of an emission authorization transmitted to the alert system or to another system.

This characteristic makes it possible to prevent that two emission authorization decisions from being made in too short a time interval, which would risk leading to the emission of several warning messages simultaneously.

The prohibition duration may range between 300 and 700 ms and, for example, is 500 ms.

According to one characteristic, the means for modulating activation of emission of a warning message comprise means for modulating transmission of an information item known as alert in progress from the authorization-issuing system to the alert system, the transmission of an information item about an alert in progress being effected if the alert system commands the emission of the warning message.

By virtue of this characteristic, as indicated in the foregoing, an information item about an alert in progress that constitutes a reliable representation of the activity of the alert system may be transmitted to the authorization-issuing system.

According to another characteristic, the management system additionally comprises means for modulating the transmission, from the alert system to the authorization-issuing system, of an emission authorization request, the transmission of an emission authorization request being effected if an alert condition associated with an activated warning message is detected.

By virtue of this characteristic, the number of requests addressed to the authorization-issuing system is reduced.

The means for modulating the transmission of an emission authorization request may be included in the alert system.

Furthermore, the management system may comprise means for modulating the transmission, from the authorization-issuing system to the alert system, of an information item about activation of a warning message possessing a priority attribute known as activation priority. These means are included, for example, in the authorization-issuing system.

Transmission of an information item about activation of a warning message may take place if the current priority threshold is modified. In general, transmission of an information item about activation of a warning message may be effected as a function of information items at the disposal of the authorization-issuing system.

Furthermore, the management system additionally may comprise means for delaying emission, by the said alert system, of an acoustic warning message for a predetermined duration known as cutoff duration, thus making it possible to supplement the warning message by a silence or a blank at its beginning. Preferably these delay means are included in the alert system.

The management system additionally may comprise means for modulating the presence of an order for a delay in the emission authorization, which means are included if applicable in the authorization-issuing system.

The emission authorization then comprises a delay order if, for example, the authorization-issuing system decides to interrupt emission of a warning message in the course of emission.

Finally, according to one characteristic, the alert system being a first alert system, the authorization-issuing system is a second alert system, its function including emission of at least one warning message associated with an alert condition whose detection duration in flight condition is short.

For example, the second alert system may be in charge of emitting automatic altitude announcements, whose detection duration under certain flight conditions (descent phases, for example) is shorter than the detection duration of other alert conditions.

Furthermore, the authorization-issuing system may have another function, such as management of acoustic emissions by a loudspeaker.

BRIEF DESCRIPTION OF THE DRAWINGS

Other characteristics and advantages of the invention will become apparent upon reading the detailed description hereinafter and the figures provided by way of illustration.

DESCRIPTION OF THE PREFERRED EMBODIMENTS

Figure 1:
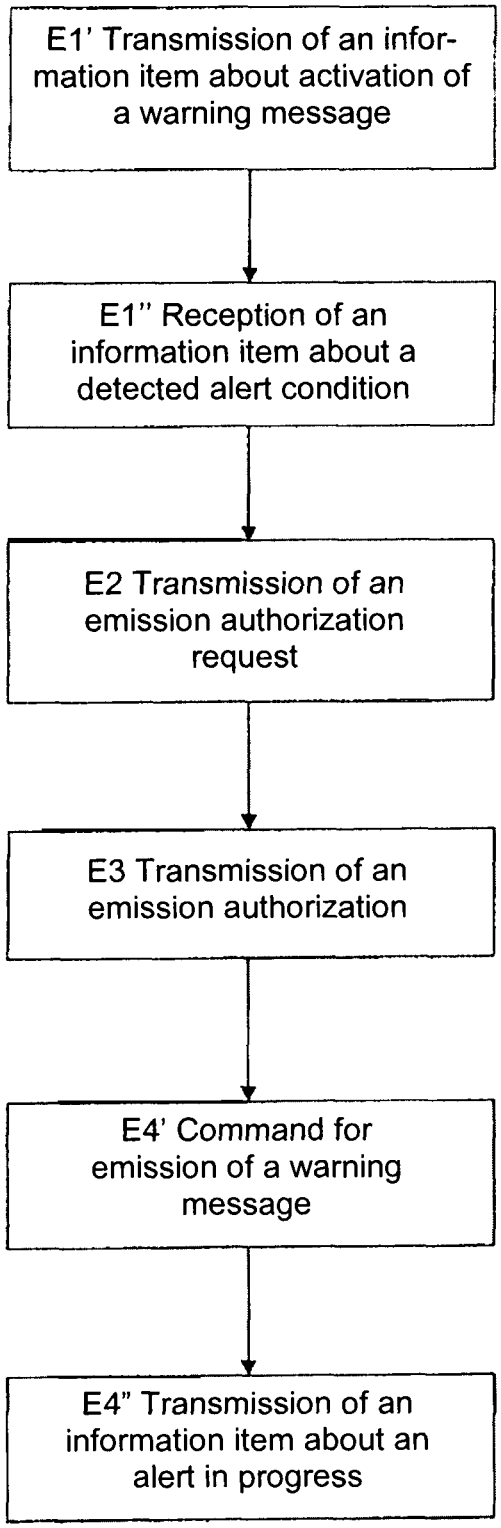
FIG. 1 is a general diagram of one embodiment of a management algorithm according to the invention.

Referring to FIG. 1, an algorithm of a process for managing the activating of an acoustic message begins with a step E1 of activation of an alert process.

Step E1 comprises firstly a sub-step E1' of transmission of an information item about activation of a warning message from a first system to a second system.

The first system is a centralizing system in charge of issuing emission authorizations, and the second system is an alert system capable of receiving an information item defining a detected alert condition and of activating the emission of a warning message.

Step E1 then comprises a sub-step E1' of reception of an information item defining a detected alarm condition, reception taking place in the second system.

The process then continues with a step E2 of transmission of an emission authorization request, effected from the second system to the first system.

This step E2 is followed by a step E3 of transmission of an emission authorization, effected from the first system to the second system.

At the end of step E3, a decision on activation of emission of the warning message associated with the detected alert condition is made in the second system.

The process ends with a step E4 of activation of emission of the warning message, which activation is effected in the second system.

This step E4 comprises firstly a sub-step E4' of commanding emission of the warning message.

Step E4 then comprises a sub-step E4" of transmission of an information item about an alert in progress, effected from the second system to the first system.

According to one variant, the sub-step E1' is effected after the sub-step E1".

According to another variant, the sub-step E4" begins before the sub-step E4'.

Referring to FIGS. 2 to 5, an aircraft is equipped with an integrated system 10 for monitoring external conditions (AESS) and with a system 20 for monitoring flight conditions (FWS).

The FWS system receives information items from different on-board systems, such as a landing gear, an engine and a fuel gauge.

Certain of these information items define alert conditions determined beforehand. According to a predetermined convention, the FWS determines, for each alert condition, a priority attribute indexed from A to D, an alert condition of attribute A taking precedence over an alert condition of attribute D. Within groups of priority attribute A and D, the alert conditions are classified according to a priority order internal to the group. Furthermore, in one embodiment, the priority attribute of the alert condition may evolve in the course of time as a function of information items measured or calculated during the flight, if applicable in real time. Nevertheless, in the described embodiment, the priority attribute of the alert condition is fixed.

Furthermore, the FWS system associates an acoustic message with certain detected alert conditions. The priority attribute of the alert condition is used as a priority attribute of the associated acoustic message.

As has already been seen, the FWS system, is among other responsibilities, in charge of emitting automatic altitude announcements in the cockpit, the validity duration of such announcements being short.

Furthermore, the FWS system emits only a single acoustic message at any one time.

The AESS system also receives information items from other systems, such as an altitude detector or a radar. In particular, it receives information items defining alert conditions, according to a predetermined condition.

For each of these alert conditions, it determines, according to a predetermined convention, a priority attribute known as priority class, and ranging between 1 and 6, an alert condition of class 1 taking precedence over an alert condition of class 6.

Furthermore, in one embodiment, the priority attribute of the alert condition may evolve in the course of time as a function of information items measured or calculated during the flight, if applicable in real time. Nevertheless, in the described embodiment, the priority attribute of the alert condition is fixed.

The AESS system associates an acoustic message with each detected alert condition. The priority attribute of the alert condition is used as the priority attribute of the associated acoustic message.

Furthermore, the AESS system emits only a single acoustic message at any one time.

The following priority rules, implemented in the FWS system, define the relationship between the acoustic messages of the two systems:

- the messages of the FWS system with priority rank A take precedence over all messages of the AESS system;
- the messages of the FWS system with priority rank B take precedence over the messages of the AESS system in classes 2 to 6, but the messages of the AESS system in class 1 take precedence over the messages of the FWS system with priority rank B;
- the messages of the FWS system with priority rank C take precedence over the messages of the AESS system in classes 3 to 6, but the messages of the AESS system in classes 1 or 2 take precedence over the messages of the FWS system with priority rank C;
- messages of the AESS system in classes 1 to 6 take precedence over the messages of the FWS system with priority rank D.

The priority scale is therefore as follows: A>1>B>2>C>3>4>5>6>D>7.

Furthermore, the FWS and AESS systems are interconnected by a communication network of the Ethernet AFDX 30 type. The two systems could be interconnected by any communication means whatsoever.

The AESS system controls the activation of acoustic messages associated with the alert conditions of which it is informed by way of a device 95 for management of acoustic emissions AMU ("Audio Multiplexer Unit").

The FWS system also controls the activation of acoustic messages associated with the alert conditions of which it is informed by way of the same AMU device 95.

When an acoustic message is in the course of emission by the FWS system, its priority attribute (A, B, C or D) defines a current priority threshold, stored in a memory of the FWS system.

When the emission of an acoustic message by the FWS system is interrupted, the FWS system assigns the value D by default to the current priority threshold.

In the described embodiment, for a given acoustic message in the course of emission, the current priority threshold does not vary with time.

In contrast, in another embodiment, it is modified by information items received by sensors and calculators and updated in real time.

The explanation will be continued with the description of the communication interface between the FWS system and the AESS system, the FWS system acting as the authorization-issuing system.

The AESS system emits binary signals of Boolean type, which can take only the values 0 and 1, intended for the FWS system.

Among the Booleans emitted from the AESS system to the FWS system, there are firstly seven REQUEST_CLASS_X Booleans, X being an integer between 1 and 7.

The AESS system assigns the value 0 by default to each of these REQUEST_CLASS_X Booleans.

When the AESS system receives an information item representative of an alert condition, it associates therewith a priority attribute X and a warning message. If the warning message is activated according to the information items at the disposal of the AESS, or if the AESS is authorized to emit a request for this warning message, the AESS system then assigns the value 1 to the REQUEST_CLASS_X Boolean.

The assignment of the value 1 to the REQUEST_CLASS_X Boolean constitutes a request for authorization to emit a class X alert message, emitted from the AESS system and intended for the FWS system. The integer X constitutes a request priority attribute for this request.

The AESS system assigns the value 0 to the REQUEST_CLASS_X Boolean as soon as it receives an information item indicating that the previously detected alert condition is no longer being detected.

The FWS system also emits information items intended for the AESS system. In particular, it also emits binary signals of Boolean type.

A first Boolean emitted from the FWS system to the AESS system is the unique AESS_AUDIO_OUTPUT_AUTHORIZED Boolean.

The FWS system maintains this Boolean at the value 0 by default, and assigns it the value 1 if it receives an emission authorization request to which it decides to respond favorably, on the basis of the aforesaid priority rules, by comparing the request priority attribute with the current priority threshold.

The assignment of the value 1 to the AESS_AUDIO_OUTPUT_AUTHORIZED Boolean defines, for the AESS system, an authorization to emit the warning message for which it emitted the most recently dated emission authorization request.

This assignment of the value 1 to the AESS_AUDIO_OUTPUT_AUTHORIZED Boolean is effected under the control of means 210 present in the FWS system (FIG. 2) in the form of software, whose function is to modulate transmission of an emission authorization from FWS system 20 to AESS system 10.

The activation of emission of the warning message is then effected by the AESS system under the control of means 110 present in the AESS system in the form of software, and having the function of modulating the activation of emission of a warning message.

A second Boolean emitted from the FWS system to the AESS system is the unique DEFERRED Boolean.

When the FWS system receives an emission authorization request originating from the AESS system while it is in the act of emitting an acoustic message, it interrupts the emission of this acoustic message if this has lower priority than the acoustic message for which the AESS system is emitting an emission request. The comparison is effected on the basis of the aforesaid priority rules.

The FWS system maintains the DEFERRED Boolean at 0 by default, and assigns it the value 1 at the same moment at which it assigns the value 1 to the AESS_AUDIO_OUTPUT_AUTHORIZED Boolean, if it thus is interrupting a warning message that it is in the act of emitting, after having received an emission authorization request.

The FWS system then maintains the DEFERRED Boolean at the value 1 for a predetermined duration, which in the described embodiment is 500 ms.

The assignment of the value 1 to the DEFERRED Boolean simultaneously with the assignment of the value 1 to the AESS_AUDIO_OUTPUT_AUTHORIZED Boolean defines, for the AESS system, an information item known as delay, indicating thereto that the emission of the acoustic message that it is authorized to undertake must be deferred by a predetermined duration.

When it receives this information item or delay order, the AESS system effects a time-delay step of 500 ms before proceeding to activation of emission of the acoustic warning message corresponding to the detected alert condition.

This delay step makes it possible to improve the intelligibility of the interrupted acoustic message and of the acoustic message activated by the crew members.

Furthermore, the FWS system automatically assigns the value 0 to the AESS_AUDIO_OUTPUT_AUTHORIZED Boolean when a predetermined duration has elapsed after it has assigned the value 1 thereto. It does the same for the DEFERRED Boolean. In the described embodiment, this duration is 500 ms.

In turn, the AESS system assigns the value 0 to the REQUEST_CLASS_X Boolean as soon as it has received an emission authorization from the FWS system.

The FWS system further comprises means for measuring a duration known as prohibition duration, which in the described embodiment is 500 ms, counted from the changeover of the AESS_AUDIO_OUTPUT_AUTHORIZED Boolean to 1. During this period of 500 ms, the FWS system prohibits the emission of any alert, regardless of its priority.

The AESS system in turn is also provided with means for measuring a duration known as activation duration, which in the described embodiment is 200 ms, counted from reception of an emission authorization, or in other words from the moment at which the AESS system receives the information item according to which the AESS_AUDIO_OUTPUT_AUTHORIZED Boolean is at 1.

The AESS system is prohibited from proceeding to activation of emission of the acoustic message corresponding to the detected alert condition if the activation duration has elapsed between reception of the emission authorization following emission of an emission authorization request and the moment at which it is capable of activating emission of the warning message.

If the AESS system is in a situation in which more than 200 ms has elapsed since reception of the emission authorization, it emits a new emission authorization request intended for the FWS system, provided the alert condition is still being detected.

Among the Booleans emitted from the AESS system to the FWS system, there are then seven CLASS_X Booleans, X being an integer between 1 and 7.

The AESS system assigns the value 0 by default to each of these Booleans, and it then assigns the value 1 to the CLASS_X Boolean when it commands the emission of a class X acoustic message.

If the AESS system effects a time-delay step of 500 ms after having received a time delay information item and before commanding the emission of a class X acoustic message, the AESS system assigns the value 1 to the CLASS_X Boolean.

For the FWS system, the fact that the CLASS_X Boolean has the value 1 defines an information item known as "alert in progress", indicating that a class X acoustic message is in the course of emission by the AESS system or is on the point of being emitted by the AESS system.

The integer X constitutes a priority attribute known as "alert in progress" for each of these information items. This priority attribute is used by the FWS system to update the current priority threshold: when the FWS system receives an information item about an alert in progress, the priority attribute of the information item about the alert in progress is used as the current priority threshold.

The assignment of the value 1 to the CLASS_X Boolean is effected under control of means for modulating transmission, from AESS system 10 to FWS system 20, of an information item about an alert in progress. This transmission is effected if the warning message is in the course of emission or is on the point of being emitted by the AESS system.

The AESS system assigns the value 0 to the CLASS_X Boolean when it terminates the emission of the class X acoustic message. When the FWS system receives this information, it assigns the value D by default to the current priority threshold, which it stores in memory.

Among the Booleans emitted from the FWS system to the AESS system, there are another seven CLASSX_AESS_AUTHORIZED Booleans, X being an integer from 1 to 7.

Each of these CLASSX_AESS_AUTHORIZED Booleans defines an activation information item or a request authorization information item, wherein the integer X is a priority attribute.

By default, the FWS system assigns the value 1 to the CLASS7_AESS_AUTHORIZED Boolean and the value 0 to all other CLASSX_AESS_AUTHORIZED Booleans.

The FWS system assigns the value 0 to all CLASSX_AESS_AUTHORIZED Booleans when a warning message of priority rank A is in the course of emission by the FWS system.

The value 1 is assigned to the CLASS1_AESS_AUTHORIZED Boolean when a warning message of priority B is in the course of emission by the FWS system. The value 0 is then assigned to the other CLASSX_AESS_AUTHORIZED Booleans.

The value 1 is assigned to the CLASS2_AESS_AUTHORIZED Boolean when a warning message of priority C is in the course of emission by the FWS system. The value 0 is then assigned to the other CLASSX_AESS_AUTHORIZED Booleans.

The value 1 is assigned to the CLASS6_AESS_AUTHORIZED Boolean when a warning message of priority D is in the course of emission by the FWS system. The value 0 is then assigned to the other CLASSX_AESS_AUTHORIZED Booleans.

Finally, the value 1 is assigned to the CLASS7_AESS_AUTHORIZED Boolean when no warning message is in the course of emission by the FWS system.

These assignments are effected under the control of means 220 for modulating the transmission, from FWS system 20 to AESS system 10, of an activation information item or of a request authorization information item, the information item being transmitted, for example, as a function of acoustic messages in the course of emission by the FWS system, on the basis of the priority rules defined in the foregoing.

By default, all warning messages of the AESS system are activated.

The assignment of the value 1 to the CLASSX_AESS_AUTHORIZED Boolean, X being an integer, indicates to the AESS system that it is authorized to emit, to the FWS system as destination, request authorizations for warning messages of classes between 1 and X, including 1 and X, and that it is not authorized to emit requests for warning messages of classes higher than or equal to X+1.

Consequently, the warning messages of classes between 1 and X, including 1 and X, are activated, and the warning messages of classes higher than or equal to X+1 are deactivated.

It is noted that, in another embodiment, the convention and scale used for the attribute of the CLASSX_AESS_AUTHORIZED request authorization information item could be different from the convention used for the REQUEST_CLASS_X requests.

When the AESS system is informed of the detection of an alert condition with which a deactivated warning message is associated, the AESS system does not emit an emission authorization request.

The AESS system emits an emission authorization request by assigning the value 1 to the REQUEST_CLASS_Y Boolean, Y being an integer, only if it has received an information item about detection of a class Y alert condition and if the warning message associated with this alert condition is activated.

The assignment of the value 1 to the REQUEST_CLASS_Y Boolean is effected under the control of means 120 present in the AESS system (FIG. 5), capable of modulating the transmission of an emission authorization request from AESS system 10 to FWS system 20.

Furthermore, if an acoustic message is in the course of emission by the AESS system while an activation information item is being transmitted to the AESS system indicating thereto that the acoustic message is deactivated, the AESS system interrupts emission of the message.

The explanation of the invention will be continued by presentation of four scenarios for management of an acoustic warning message in an aircraft cockpit equipped with a management system according to the first embodiment of the described management system (FIGS. 2 to 5).

Figure 2:
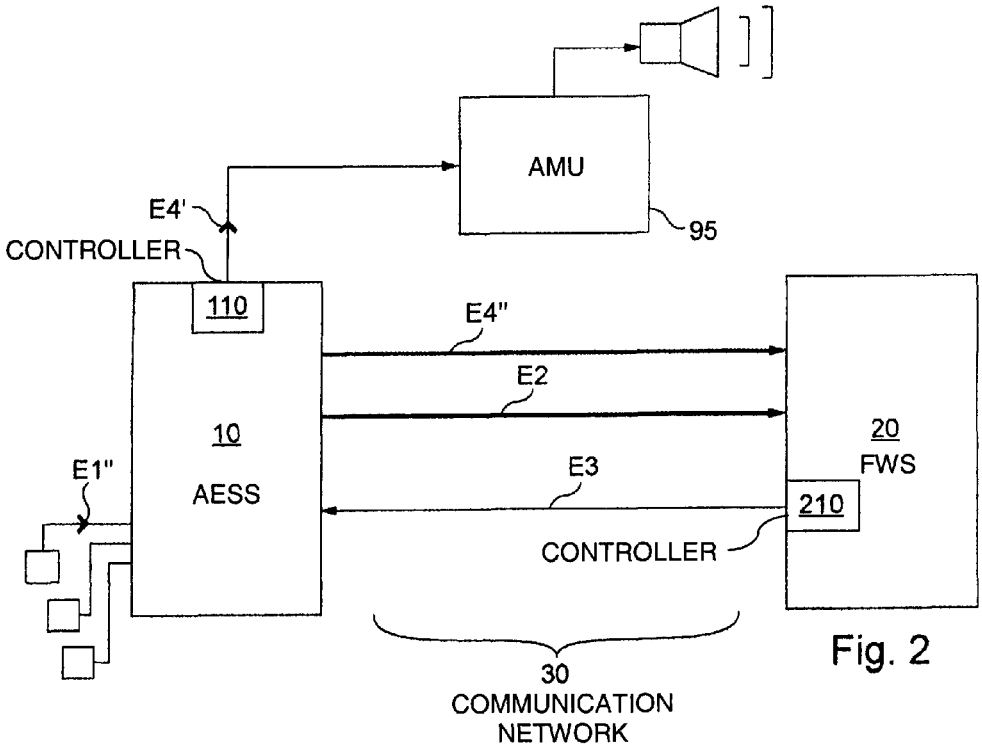
FIGS. 2 to 5 are diagrams illustrating four scenarios for implementation of the management process according to the invention, in relation to a first embodiment of the management system.

In a first scenario, represented in FIG. 2, the AESS system detects the "GLIDE SLOPE, mode 5" alert condition, which is a class 5 alert condition, while no warning message is in the course of emission by either the FWS system or the AESS system.

At the beginning of this scenario, all warning messages of the AESS system are activated.

The reception, by the AESS system, of an information item defining the "GLIDE SLOPE, mode 5" alert condition takes place at the moment to (step E1").

At a later moment t1, the AESS system assigns the value 1 to the REQUEST_CLASS_5 Boolean (beginning of step E2). This assignment constitutes a request from the AESS system to the FWS system with a view to obtaining permission to emit a class 5 alert message.

At a later moment t2, the FWS system records this request (end of step E2). At the same moment, it assigns the value 1 to the AESS_AUDIO_OUTPUT_AUTHORIZED Boolean, indicating that the AESS system is authorized to emit the alert in question (beginning of step E3).

At a later moment t3, the AESS system records the emission authorization (end of step E3).

At a moment t4, after an additional delay, the AESS system begins emission of the acoustic alert "GLIDE SLOPE" (step E4').

At a moment t5, after a new delay, the AESS system assigns the value 1 to the CLASS_5 Boolean, indicating that the emission of a class 5 alert message is in progress by the AESS system (beginning of step E4").

At a moment t6, the FWS system records this information item (end of step E4").

Figure 3:
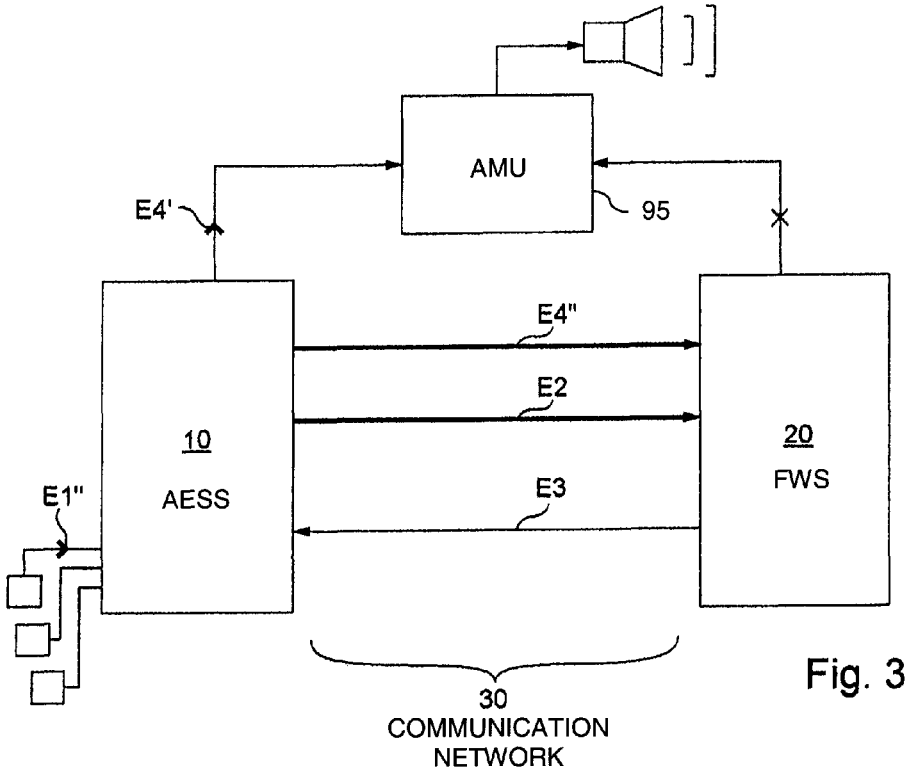

In a second scenario, represented in FIG. 3, an acoustic warning message "PITCH" is in the course of emission by the FWS system when an alert condition is being detected by the AESS system.

At the beginning of the scenario, all warning messages of the AESS system are activated.

At the moment t0, the FWS system is in the act of emitting the alert message "PITCH PITCH".

At a moment t1, the AESS system detects the class 2 alert "PWS Warning" (for "Predictive Windshear Warning") (step E1"). The associated message is "WINDSHEAR AHEAD, WINDSHEAR AHEAD", indicating that shearing winds are detected ahead of the airplane.

At a later moment t2, the AESS system assigns the value 1 to the REQUEST_CLASS_2 Boolean, thus requesting the FWS system to authorize emission of a class 2 acoustic message (beginning of step E2).

At a later moment t3, the FWS system records this information item (end of step E2).

The FWS system interrupts emission of the message "PITCH PITCH" at a moment t4.

At a moment t5, the FWS system assigns the value 1 to the AESS_AUDIO_OUTPUT_AUTHORIZED Boolean, indicating that it is authorizing the AESS system to emit an alert message (beginning of step E3). It also changes its DEFERRED Boolean over to 1, indicating that the AESS system must wait 500 ms before beginning emission.

At a moment t6, the AESS system records these information items (end of step E3).

Starting from the moment t6, the AESS system assigns the value 1 to the CLASS_2 Boolean, indicating that it is trying to emit a class 2 alert message (beginning of step E4").

Starting from this moment t6, the AESS system commands the emission of the acoustic message "WINDSHEAR AHEAD, WINDSHEAR AHEAD", this being supplemented at its beginning by a silence of 500 ms (step E4").

At a moment t7, the FWS system records the information item according to which the AESS system is trying to emit a class 2 alert message (end of step E4").

Figure 4:
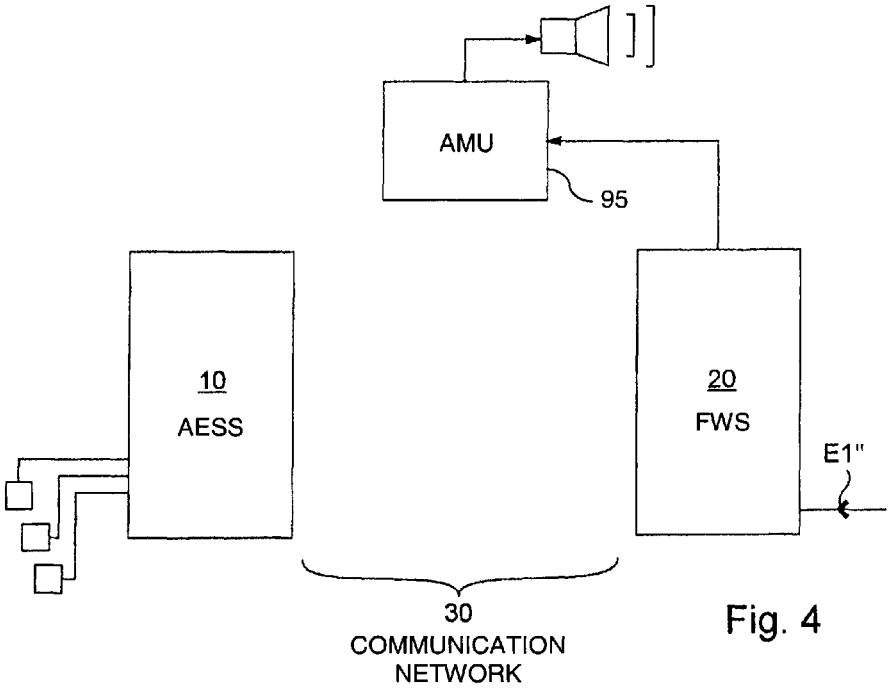

In a third scenario, represented in FIG. 4, the FWS system detects a condition of automatic altitude announcement while the airplane is in a descent phase.

At the moment t0, the FWS system and the AESS system are both in a waiting state, without any alert condition having been detected and without there being any message in the course of emission. All CLASS_X Booleans of the AESS system are at 0.

At the moment t1, the FWS system detects a condition of automatic altitude announcement. This is a "500" automatic altitude announcement, for which the alert message is "FIVE HUNDRED".

At a moment t2, the FWS system activates emission of the acoustic message "FIVE HUNDRED". The moment t2 follows the moment t1 by one calculation cycle of the FWS system, or in other words by less than 60 ms.

At a moment t3, the conditions of the automatic altitude announcement ("500") previously detected by the FWS system since the moment t1 cease, the airplane having changed altitude rapidly.

This scenario illustrates the advantage of the fact that the authorization-issuing system is an alert system, whose function is to emit warning messages associated with alert conditions that remain valid for only a few moments under given flight conditions.

If the AESS had been the authorizing system, the FWS would have had to request emission authorization from the AESS system, and it would have received such authorization at a moment at which the altitude announcement message could no longer have been pertinent, the altitude of the airplane having changed.

Figure 5:
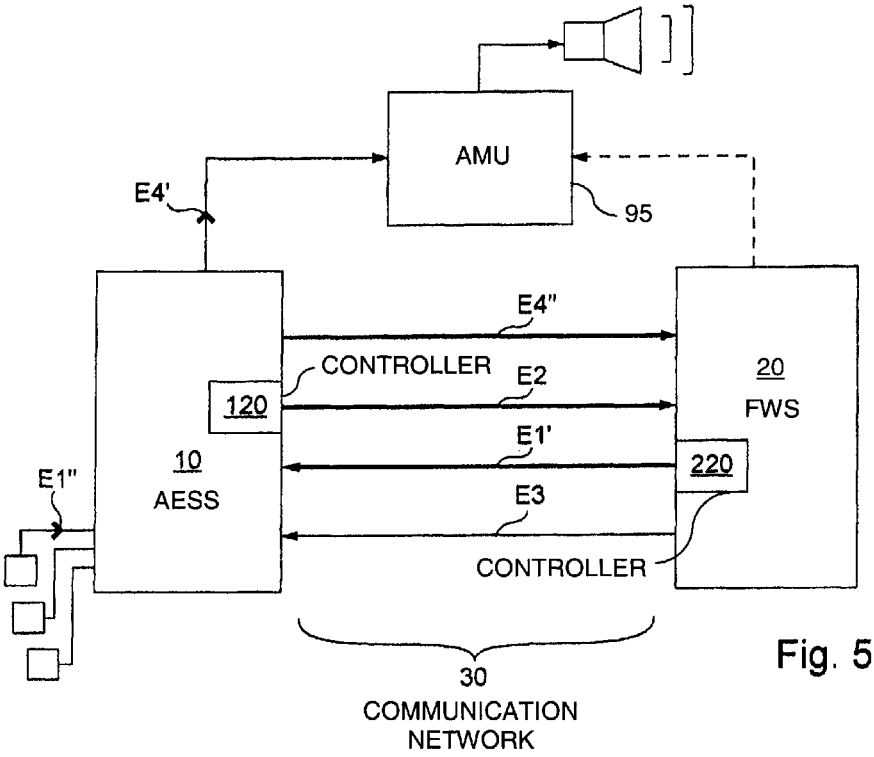

In a fourth scenario, represented in FIG. 5, a class 1 alert condition is detected by the AESS system while the alert message "Stall" is in the course of emission by the FWS system. The conditions for activation of the alert "Stall" cease after several moments, but the class 1 alert conditions persist.

At the moment t0, the FWS system is in the act of emitting the alert "STALL STALL". All warning messages of the AESS system are deactivated, the "Stall" message taking precedence over all messages of the AESS system.

At a later moment t1, the AESS system detects the class 1 alert conditions "PULL UP mode 1", for which the associated message is "PULL UP" (step E1").

Since this message is deactivated at that moment, the AESS system does not emit an emission authorization request. The FWS system continues to emit the message "STALL STALL".

At a moment t2 subsequent to t1, the FWS system ceases to detect the alert conditions "STALL STALL".

Starting from the moment t3, the FWS system ceases to emit the alert message "STALL STALL", and it assigns the value 1 to the CLASS7_AESS_AUTHORIZED Boolean, indicating that all messages of the AESS system are activated (beginning of step E1').

Starting from a moment t4, the AESS system records this information item (end of step E1'). It verifies that the alert condition Pull up is still being detected, then assigns the value 1 to the REQUEST_CLASS_1 output Boolean, indicating that it is emitting an emission authorization request intended for the FWS system (beginning of step E2).

Starting from a later moment t5, the FWS system records the request (end of step E2). The value 1 is assigned to the AESS_AUDIO_OUTPUT_AUTHORIZED Boolean at this moment t5, the FWS system indicating to the AESS system that it is authorized to emit an alert message (beginning of step E3).

Starting from a moment t6, the AESS system records the emission authorization (end of step E3) and emits the alert message "PULL UP" (step E4').

The AESS system also assigns the value 1 to the CLASS_1 Boolean, thus indicating to the FWS system that it is in the act of emitting a class 1 alert message (beginning of step E4"). At a moment t7, the FWS system records this information item (end of step E4").

Figure 6:
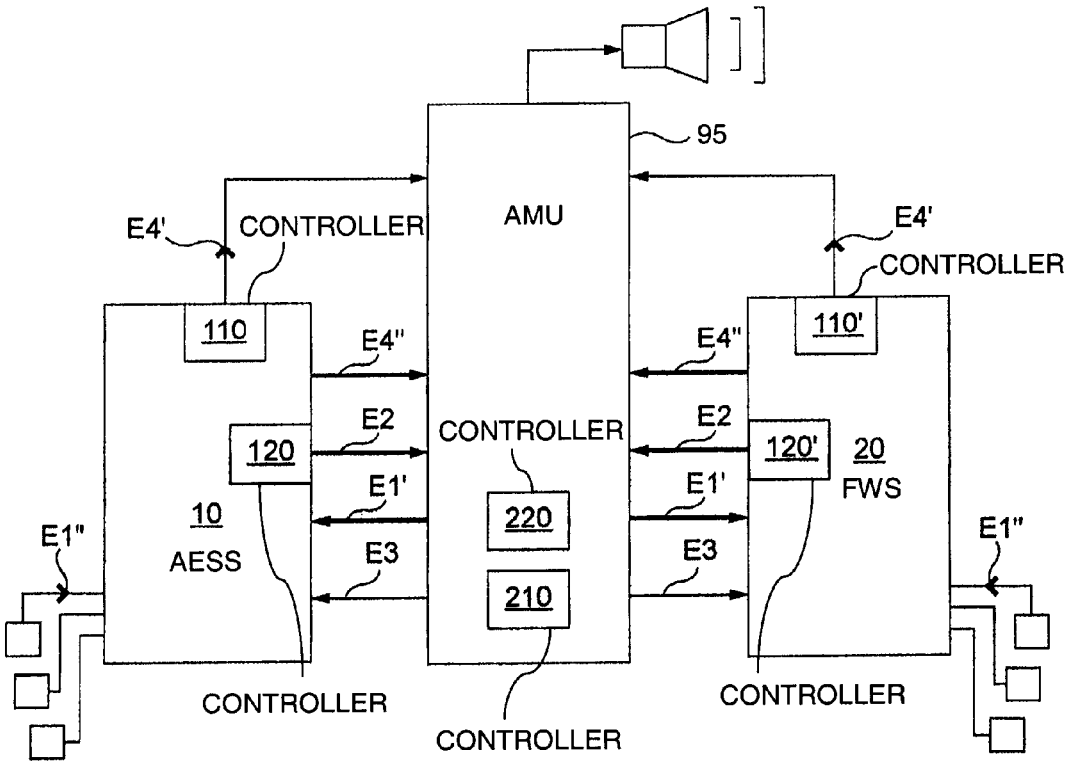
FIG. 6 is a diagram of a second embodiment of the management system according to the invention.

According to a second embodiment of the management system represented in FIG. 6, the authorization-issuing system is not an alert system but instead is a third system distinct from the FWS system and from the AESS system. As it happens, this third system is a system 95' for managing acoustic emissions (AMU).

In this embodiment, FWS system 20 and also AESS system 10 must request emission authorization from system 95' before emitting an acoustic message.

The priority rules are implemented in the authorization-issuing system.

In addition, FWS system 20, like AESS system 10, informs system 95' when it is in the act of emitting an acoustic message, by transmitting thereto an information item about an alert in progress, in a manner similar to that presented hereinabove.

In addition, system 95' may activate or deactivate warning messages of the FWS system, like the AESS system, in a manner similar to that presented hereinabove.

In this embodiment, means 210 for modulating transmission of an emission authorization and means 220 for modulating transmission of an activation information item are included in system 95'.

In this same embodiment, means 110' for modulating the activation of emission of a warning message and means 120' for modulating the transmission of an emission authorization request are also present in FWS system 20.

The invention claimed is:

1. A process for managing the activating of emission of a warning message in an aircraft, the process comprising:

transmitting, from a monitoring system to an authorization-issuing system, a request to authorize emission of the warning message, the request possessing a priority attribute known as request priority attribute;

transmitting, from the authorization-issuing system to the monitoring system, an emission authorization to emit the warning message, and the transmitting the emission authorization is effected if the request priority attribute is higher than a current priority threshold; and activating, by a controller in the monitoring system, emission of the warning message.

2. A process according to claim 1, wherein the activating emission of the warning message further comprises transmitting, from the monitoring system to the authorization-issuing system, an information item known as alert in progress, the transmitting being performed if the monitoring system is effectively commanding the emission of the warning message.

3. A process according to claim 1 or 2, wherein the transmitting the request to authorize emission of the warning message is preceded by activating an alert process, comprising transmitting, from the authorization-issuing system to the monitoring system, an information item about activation of the warning message, and transmitting the emission authorization request is effected if an alert condition associated with an activated warning message is detected.

4. A system for managing the activating of emission of a warning message, the system comprising:

means for transmitting a request for authorization to emit the warning message from a monitoring system to an authorization-issuing system;

means for transmitting an authorization to emit the warning message from the authorization-issuing system to the monitoring system;

means for modulating transmission of an authorization to emit the warning message, the transmission of the authorization to emit the warning message being effected if a priority attribute known as request priority attribute of a request to authorize emission of the warning message transmitted from the monitoring system to the authorization-issuing system is higher than a current priority threshold; and means for activating emission, by a controller in the monitoring system, of the warning message.

5. An authorization-issuing system for managing the activating of emission of a warning message, the system comprising:

a receiving section that receives, from a monitoring system, a request for authorization to emit a warning message;

a transmitting section that emits an authorization to emit the warning message;

a threshold updating section configured to update a current priority threshold; and a transmission modulation section that modulates the emission by the transmitting section of the authorization to emit the warning message, the emission of the authorization to emit being effected if a priority attribute, known as request priority attribute, of the request for authorization to emit the warning message received by the receiving section is higher than the current priority threshold.

6. An authorization-issuing system according to claim 5, wherein the transmission modulation section comprises means for measuring a duration known as prohibition duration, counted from a preceding transmission of an authorization, the transmission of the authorization to emit being effected after the end of the prohibition duration.

7. An authorization-issuing system according to claim 5, further comprising:

an emission modulating section configured to modulate the emission of an information item about activation of warning messages possessing a priority attribute known as activation priority, emission of an information item about activation of warning messages being effected if the current priority threshold is modified.

8. An authorization-issuing system according to claim 5, wherein the authorization-issuing system includes a monitoring system, and a function of the monitoring system includes emission of at least one automatic altitude announcement.

9. An authorization-issuing system according to claim 5, wherein the authorization-issuing system has priority rules implemented therein defining a relationship between messages of at least two monitoring systems.

10. An authorization-issuing system according to claim 5, wherein said authorization-issuing system is a computer.

11. A monitoring system for activating of emission of a warning message, the system comprising:

a transmitting section configured to emit, to an authorization-issuing system, a request for authorization to emit the warning message;

a receiving section configured to receive an authorization to emit the warning message from the authorization-issuing system; and an emission activation modulation section in a controller of the monitoring system configured to modulate the activation of the emission of the warning message, the activation of the emission of the warning message being undertaken upon reception of the authorization to emit by the receiving section if an alert condition associated with the warning message is still detected.

12. A monitoring system according to claim 11, wherein the warning message is supplemented at its beginning by a silence of predetermined duration, known as cutoff, if the emission authorization comprises a time delay order.

13. A monitoring system according to claim 11, wherein the emission activation modulation section includes means for measuring a duration known as activation duration, counted from the reception of the authorization to emit, the emission of the warning message being activated only during the activation duration.

14. A monitoring system according to claim 11, wherein the emission activation modulation section comprises means for modulating emission of an information item known as alert in progress, the emission of the information item about the alert in progress being effected if the monitoring system is effectively commanding the emission of the warning message.

15. A monitoring system according to claim 11, including at least two systems from the group consisting of TAWS, GPWS, TCAS, WxR and PWS.

16. A monitoring system according to claim 11, further comprising an emission modulating section configured to modulate the emission of a request for authorization, the request being emitted only if an alert condition associated with an activated warning message is detected.

17. A system for managing the activation of emission of a warning message, the system comprising:

a monitoring system that includes a first transmitting section configured to emit, to an authorization-issuing system, a request for authorization to emit the warning message, a first receiving section configured to receive an authorization to emit the warning message from the authorization-issuing system, and an emission activation modulation section in a controller of the monitoring system configured to modulate the activation of the emission of the warning message, the activation of the emission of the warning message being undertaken upon reception of the authorization to emit by the first receiving section if an alert condition associated with the warning message is still detected; and an authorization-issuing system that includes a second receiving section that receives, from the monitoring system, the request for authorization to emit the warning message, a second transmitting section that emits the authorization to emit the warning message, a threshold updating section configured to update a current priority threshold, and a transmission modulation section that modulates the emission by the second transmitting section of the authorization to emit the warning message, the emission of the authorization to emit being effected if a priority attribute, known as request priority attribute, of the request for authorization to emit the warning message received by the receiving section is higher than the current priority threshold.

18. A system according to claim 17, wherein the monitoring system and the authorization-issuing system are interconnected by an Ethernet network.

19. A system according to claim 17, wherein the authorization-issuing system includes a second monitoring system that emits at least one warning message associated with an alert condition, when a detection duration of the alert condition during a flight condition is shorter than a detection duration of the alert condition when monitored by the monitoring system.

* * * * *